US006987488B1

(12) United States Patent
Chang et al.

(10) Patent No.: US 6,987,488 B1
(45) Date of Patent: Jan. 17, 2006

(54) ELECTROMAGNETIC PHASE SHIFTER USING PERTURBATION CONTROLLED BY PIEZOELECTRIC TRANSDUCER AND PHA ARRAY ANTENNA FORMED THEREFROM

(75) Inventors: Kai Chang, College Station, TX (US); Tae-Yeoul Yun, College Station, TX (US); Raghbir S. Tahim, Burna Park, CA (US)

(73) Assignees: The Texas A&M University System, College Station, TX (US); RST Scientific Research, Inc., Anaheim, CA (US)

( * ) Notice: Subject to any disclaimer, the term of this patent is extended or adjusted under 35 U.S.C. 154(b) by 251 days.

(21) Appl. No.: 09/796,659

(22) Filed: Feb. 28, 2001

Related U.S. Application Data

(60) Provisional application No. 60/269,569, filed on Feb. 16, 2001.

(51) Int. Cl.
*H01Q 13/08* (2006.01)
*H01P 1/18* (2006.01)

(52) U.S. Cl. ..... 343/767; 333/161

(58) Field of Classification Search ..... 333/161, 333/159, 157; 343/767, 795
See application file for complete search history.

(56) References Cited

U.S. PATENT DOCUMENTS 4,575,697 A * 3/1986 Rao et al. ..... 333/159 X
4,768,001 A * 8/1988 Chan-Son-Lint et al. ... 333/159
5,406,233 A * 4/1995 Shih et al. ..... 333/161
5,504,466 A * 4/1996 Chan-Son-Lint et al. ... 333/159
6,016,122 A * 1/2000 Malone et al. ..... 333/159 X
6,317,094 B1 * 11/2001 Wu et al. ..... 343/767

OTHER PUBLICATIONS

"*Tunable Dielectric Resonators with Dielectric Tuning Disks in Cyclindrical Enclosures*", By: Tao Shen, et al.; Department of Electrical and Computer Engineering University of Maryland, College Park, MD 20742 USA; IEEE MTT–S Digest; pp. 1441–1444, 2000.

"*Voltage–Controlled Ferroelectric Lens Phased Arrays*", By: Jaganmohan B.L. Rao, et al.; IEE Transactions on Antennas and Propagation; vol. 47, No. 3, pp. 458–468, Mar. 1999.

"*Unified Approach to Solve a Class of Strip and Microstrip–Like Transmission Lines*"; By: Bharathi Bhat, et al.; IEE Transactions on Microwave Theory and Techniques, vol. MTT–30, No. 5; pp. 679–686, May, 1982.

"*A Phased–Array Antenna Using a Multi–line Phase Shifter Controlled by a Piezoelectric Transducer*", By: Tae–Yeoul Yun and Kai Chang, Department of Electrical Engineering, Texas A&M University, College Station, TX; pp. 1–5, Feb. 27, 2000.

"*An Elecronically Tunable Photonic Bandgap Resonator Controlled by Piezoelectric Transducer*", By: Tae–Yeoul Yun and Kai Chang, Department of Electrical Engineering, Texas A&M University, College Station, TX; pp. 1–5, Feb. 27, 2000.

(Continued)

*Primary Examiner*—Benny T. Lee
(74) *Attorney, Agent, or Firm*—Baker Botts L.L.P.

(57) ABSTRACT

An apparatus for introducing electromagnetic perturbation into a target device includes a piezoelectric transducer configured to deflect in response to an applied voltage and a perturber configured to deflect in response to deflection of the piezoelectric transducer. The deflection of the perturber causes electromagnetic perturbation, and in some cases a phase shift, in the target device. The electromagnetic perturbation may also be used to tune microwave devices such as filters, resonators, and oscillators.

26 Claims, 4 Drawing Sheets

OTHER PUBLICATIONS

"*Magnetically Tunable Rectangular Waveguide E–Plane Integrated Circuit Filters*", By: Jaroslaw Uher, et al., IEE Transactions on Microwave Theory and Techniques, vol. 36, No. 6; pp. 1014–1022, Jun. 1998.

"*New Tunable Phase Shifters Using Perturbed Dielectric Image Lines*", By: Ming–yi Li and Kai Chang; IEE Transactions on Microwave Theory and Techniques, vol. 46, No. 10; pp. 1520–1523, Oct. 1998.

"*New Empirical Unified Dispersion Model for Shielded–, and Suspended–, Composite–Substrate Microstrip Line for Microwave and mm–Wave Applications*", By: A.K. Verma and Raji Kumar; IEE Transactions on Microwave Theory and Techniques, vol. 46, No. 8; pp. 1187–1192, Aug. 1998.

"*A Low–Loss Time–Delay Phase Shifter Controlled by Piezoelectric Transducer to Perturb Microstrip Line*", By: Tae–Yeoul Yun and Kai Chang, Department of Electrical Engineering, Texas A&M University, College Station, TX; pp. 1–3, Feb. 27, 2000.

"*One–Dimensional Photonic Bandgap Resonators and Varactor Tuned Resonators*", By: Tae–Yeoul Yun and Kai Chang, Department of Electrical Engineering, Texas A&M University, College Station, TX; pp. 1–4, Feb. 27, 2000.

*Design and Development of Ferroelectric Tunable Microwave Components for Ku– and K–Band Satellite Communication Systems*, By: Felix A. Miranda, et al.; IEE Transactions on Microwave Theory and Techniques, vol. 48, No. 7, pp. 1181–1189, Jul. 2000.

"*Tunable Microwave and Millimeter–Wave Band–Pass Filters*"; By: Jaroslaw Uher, et al.; IEE Transactions on Microwave Theory and Techniques, vol. 39, No. 4, pp. 643–653, Apr. 5, 1991.

"*Synthesis Techniques for High Performance Octable Bandwidth 180° Analog Phase Shifters*", By: Stephan Lucyszyn; IEEE Transactions on Microwave Theory and Techniques, vol. 40, No. 4, pp. 731–740, Apr. 1992.

"*Distributed Analog Phase Shifters with Low Insertion Loss*", By: Amit S. Nagra, et al.; IEEE Transactions on Microwave Theory and Techniques, vol. 47, No. 9, pp. 1705–1711, Sep. 1999.

* cited by examiner

ELECTROMAGNETIC PHASE SHIFTER USING PERTURBATION CONTROLLED BY PIEZOELECTRIC TRANSDUCER AND PHA ARRAY ANTENNA FORMED THEREFROM

CROSS-REFERENCE TO RELATED APPLICATION

This application claims benefit of U.S.C. § 119(e) of the provisional application having a title of "Tunable Circuits and Devices Controlled by Piezoelectric Transducers", a filing date of Feb. 16, 2001, Ser. No. 60/269,569.

TECHNICAL FIELD OF THE INVENTION

This invention relates generally to electronic systems and more particularly to electromagnetic perturbation utilizing a piezoelectric transducer.

BACKGROUND OF THE INVENTION

Phase shifters are utilized to introduce a shift in phase of an electrical signal. There are many applications for the use of phase shifters in which shifting a phase in an electrical signal is desired. As one example, phase shifters are often used in antenna arrays. Other examples include timing recovery circuits and phase equalizers for data channels.

Antenna arrays may be designed with a plurality of antennas, each transmitting and receiving an electrical feed. Phase shifters are often used to introduce a phase shift into each of the feeds. The result of introducing phase shift into each of the feeds is a steering of the resulting beam projected by the antenna. Rather than utilizing an antenna that rotates or otherwise moves, the direction at which the antenna electrically points is affected by introducing phase shift into the feeds of the antennas. This is referred to as beam steering.

Many existing phase shifters suffer from various disadvantages. For example, many phase shifters are narrow band, meaning they can operate in only a narrow range of frequencies. In addition, such phase shifters are often high loss devices or provide only a small phase shift. Such devices include monolithic microwave integrated circuit, ferroelectric, solid-state, and photonically controlled phase shifters. Beam steering methods using a ferrite plate have been developed for low cost systems but require very high voltages up to several kV. One example of such a ferrite plate shifter requires impedance matching transformers to a polarization rotator for two dimensional arrays, large size lens, power consumption of 0.5 W, and forced air cooling. In addition these phase shifters are often expensive and inefficient.

SUMMARY OF THE INVENTION

Therefore, a need has arisen for an improved phase shifter and associated method. The present invention provides a system and method for introducting phase shift into an electric circuit, including phased array antennas and other devices.

According to one embodiment of the invention, an apparatus for introducing phase shift into an electric circuit includes a piezoelectric transducer configured to deflect in response to an applied voltage, a microstrip or other transmission line, and a perturber separated from the microstrip line by a gap and configured to deflect in response to deflection of the piezoelectric transducer. The deflection of the perturber causes a phase shift in an electric current flowing through the microstrip line.

According to another embodiment of the invention, a phased array antenna system includes an antenna array comprising a plurality of antennas, a plurality of microstrip lines connected in a one-to-one fashion with respective ones of the plurality of antennas, a perturber disposed proximate the plurality of microstrip lines, and a piezoelectric transducer coupled to the perturber such that deflection of the piezoelectric transducer causes deflection of the perturber with respect to the plurality of microstrip lines thereby introducing a phase shift in each of the microstrip lines.

Some embodiments of the invention provide numerous technical advantages. Other embodiments may realize some, none, or all of these advantages. For example, according to one embodiment, a piezoelectric transducer controlled multi-line phase shifter is provided that results in high bandwidth, low-loss, and large phase shift in a relatively inexpensive manner. Some embodiments do not require any impedance matching circuits, such as those found in ferrite plate shifters. Additional advantages of some embodiments include smaller size, lower power consumption (<1 mw in one example) lower DC control voltage (approximately 60 volts in one example), and wider operating bandwidth due to a true time-delay type of phase shifting. The bandwidth of such a piezoelectric transducer phase shifter is very wide because the perturbation of the transmission line changes the phase in the transmission line but does not significantly affect its characteristic impedance.

Other advantages may be readily ascertainable by those skilled in the art and the following FIGURES, description, and claims.

BRIEF DESCRIPTION OF THE DRAWINGS

For a more complete understanding of the present invention and the advantages thereof, reference is now made to the following description taken in conjunction with the accompanying drawings, wherein like reference numbers represent like parts, and which.

DETAILED DESCRIPTION OF THE INVENTION

Embodiments of the invention and its advantages are best understood by referring to FIGS. 1A, 1B, 2, 3, 4A, 4B, 5, and 6 of the drawings, like numerals being used for like and corresponding parts of the various drawings.

Figure 1A:
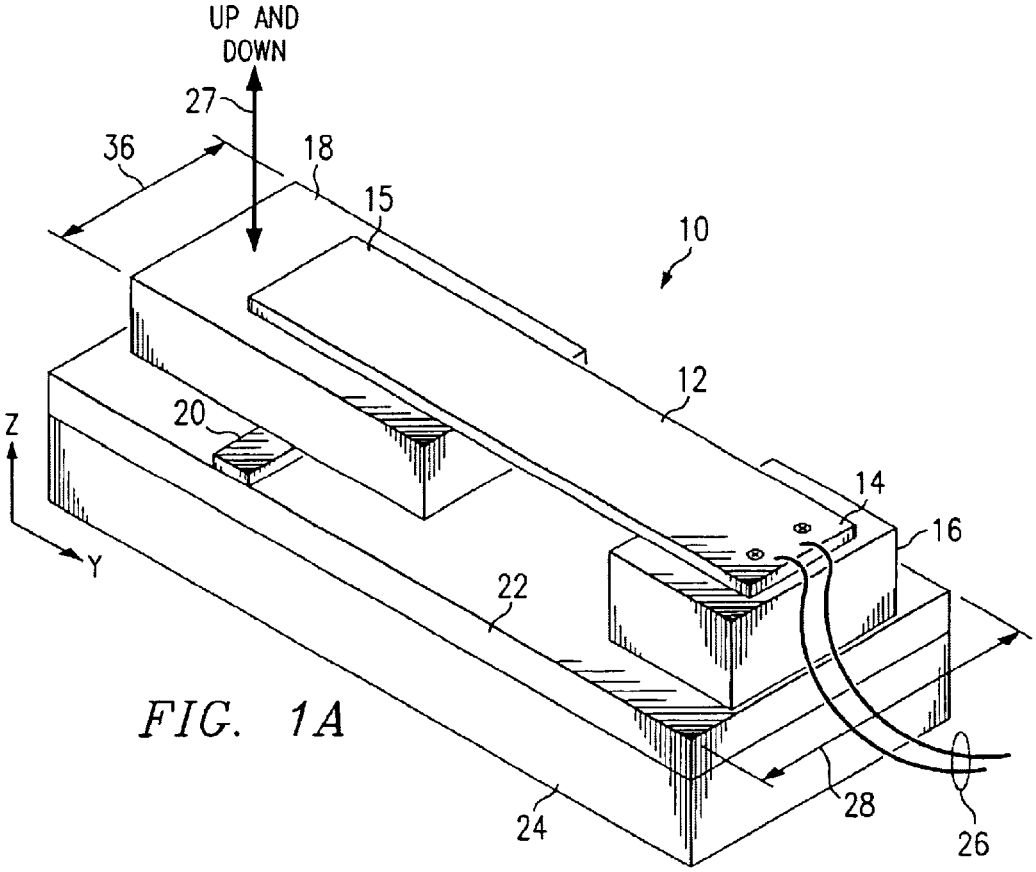
FIG. 1A is an isometric drawing of one embodiment of a phase shifter according to the teachings of the present invention.

FIG. 1A is an isometric drawing of a piezoelectric transducer phase shifter 10 according to the teachings of the invention. Piezoelectric transducer phase shifter 10 includes a piezoelectric transducer 12 supported at one end 14 by a supporter 16. Piezoelectric transducer phase shifter 10 also includes a perturber 18 coupled to piezoelectric transducer 12. Piezoelectric transducer phase shifter 10 also includes a microstrip line 20 formed on a substrate 22. Microstrip line 20 has a length 28. Also illustrated is a test fixture 24 for supporting substrate 22 and the remainder of piezoelectric transducer phase shifter 10. In this embodiment, piezoelectric transducer 12 is attached to a direct current voltage source (not explicitly shown) by electrical lines 26.

In operation, a voltage is applied on electrical lines 26 to piezoelectric transducer 12. Application of such a voltage causes piezoelectric transducer 12 to displace up or down at a free end 15, as denoted by arrow 27. This displacement in turn causes perturber 18 to also displace up or down. Displacement of perturber 18 with respect to microstrip line 20 disturbs the electromagnetic field around microstrip line 20. This disturbance results, in this embodiment, in a phase shift in microstrip line 20. The amount of this phase shift may be controlled by the proximity of perturber 18 with respect to microstrip line 20, the distance at which perturber 18 is positioned along length 28 of the microstrip line, and other parameters as described below. In this manner, a selectable phase shift can be introduced into an electrical current running through microstrip line 20, which may be used for a variety of purposes, including steering a phased antenna array. Other applications of utilizing a piezoelectric transducer to disturb an electromagnetic field in a conductor, transmission line, dielectric resonator, or other device in which a disturbance of an electromagnetic field surrounding the device is desired, referred to herein as target device, include tuning microwave circuits, tuning photonic bandgap resonators, tuning dielectric resonator oscillators, and other suitable applications. In such examples instead of the disturbance of the electromagnetic field generating a phase shift, the disturbance of the field results in a frequency change that is used for tuning purposes.

Figure 1B:
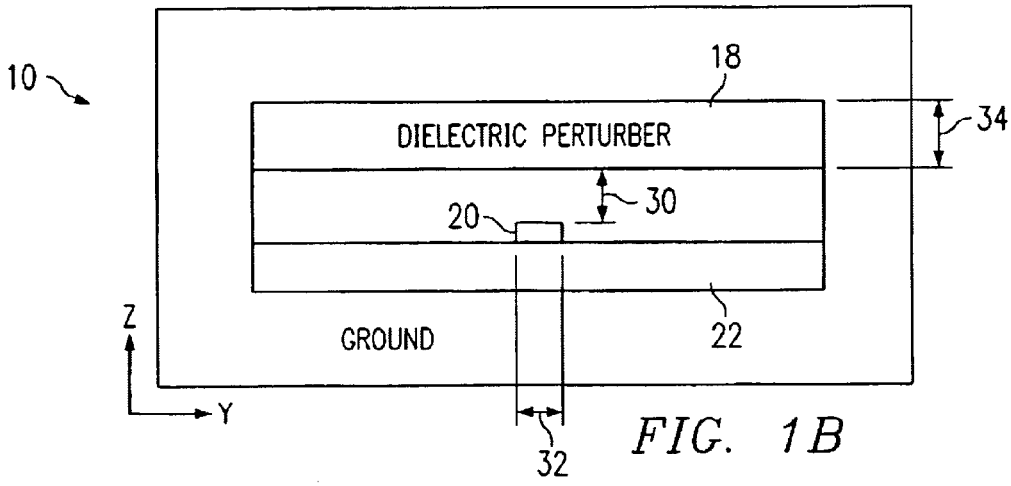
FIG. 1B is a cross-sectional drawing of a portion of the phase shifter of FIG. 1A showing an enlarged view of the perturber, the microstrip line, and the substrate of FIG. 1A.

Additional details of this embodiment are described in conjunction with FIGS. 1A and 1B. FIG. 1B is a cross-sectional drawing of a portion of piezoelectric transducer phase shifter 10 showing a GROUND, perturber 18, microstrip line 20, and substrate 22. In the illustrated embodiment, perturber 18 is a dielectric perturber. GROUND of FIG. 1B is an electrical ground. According to one embodiment, piezoelectric transducer 12 (FIG. 1A) is a piezoelectric ceramic; however, other types of piezoelectrics may be used. According to one embodiment, piezoelectric transducer 12 is formed with a rectangular shape having dimensions of 2.75 inches by 1.25 inches by 0.085 inches and is formed from Lead Zirconate Titanate; however other dimensions, configurations, and materials may be used. The amount of deflection of piezoelectric transducer 12 depends on the applied voltage. In this embodiment, a voltage of between 0 and 90 volts is applied. At 90 volts, piezoelectric transducer 12 deflects downward 1.325 mm and at 0 volts no deflection occurs; however, piezoelectric transducer 12 may operate at different voltage levels and may deflect upward rather than downward in response to an applied voltage.

Supporter 16 may be formed from any suitable material that can mechanically support piezoelectric transducer phase shift 12, such as a metal, dielectric, or insulator. The electrical characteristics of supporter 16 may be insulative or conductive. Piezoelectric transducer 12 may be coupled to supporter 16 by screws or any other suitable manner.

In this embodiment, perturber 18 has a dielectric constant of 10.8, a height 34 (FIG. 1B) of 0.050 inches, and a length 36 (FIGS. 1A, 1B) of 1.8 inches; however, other dimensions and parameters may be used depending on the application. Generally, the induced phase shift in microstrip line 20 is proportional to the length of the perturbed length of microstrip line 20. Therefore, to achieve greater phase shift, the length of perturber 18 is increased. Although perturber 18 is perturbed in the Z-axis (FIGS. 1A, 1B) in this embodiment, perturber 18 may move horizontally in the Y-axis (FIGS. 1A, 1B), or rotate. Forming perturber 18 from a dielectric material is advantageous because such perturbers result in low loss operation; however, perturber 18 may also be formed from a metal, or a metal-covered dielectric. Width 32 (FIG. 1B) of microstrip line 20 is designed in this embodiment to result in a high characteristic impedance of approximately 55 ohms to compensate for decreased characteristic impedance due to dielectric perturbation; however, other suitable characteristic impedances may be prescribed. Although in this embodiment perturber 18 is distinct from transducer 12, perturber 18 may also be formed integral with, or as a part of, transducer 12.

The use of microstrip line 20 is desirable because of the resulting quasi-transverse electromagnetic mode without cutoff frequency and its easy fabrication with no waveguide transition required. Other transmission lines, or conductors, may also be employed, including coplaner wave guides, coplaner strips, slot lines, and other transmission lines. In this embodiment, microstrip line 20 has a length 28 of 3 inches and a width 32 of 0.022 inches; however, other dimensions may be used.

Perturbation of the electromagnetic fields surrounding microstrip line 20 changes the distributed capacitance, which corresponds to a variation of the effective permitivity and propagation constant, and thus, results in a phase shift. The characteristic impedance of microstrip line 20 is only slightly affected by the perturbation and no additional impedance matching circuit is required for broadband operation.

Substrate 22 may be formed from any material operable to support microstrip line 20; however, according to one embodiment substrate 22 is formed from RT/DUROID 6010.8 with a dielectric constant of 10.8 and a height of 0.025 inches.

As illustrated in FIG. 1B, an air gap 30 exists between dielectric perturber 18 and microstrip line 20. This distance varies in response to displacement of perturber 18. Air gap 30 may be any suitable distance; however, gaps in the range of 0 to 3 mm have been found to be particularly advantageous, with most phase shift occurring where air gap 30 is reduced to less than 0.5 mm.

The above description provides example dimensions and parameters that are meant only as examples. In general, it has been determined that a higher permitivity of substrate 22 and perturber 18 results in more desirable operation, such as greater phase shift and less loss. It is additionally desirable to provide a thicker perturber 18. For example one particularly advantageous criteria for construction of perturber 18 is a thickness 34 that is at least twice as great as the thickness of substrate 22. It has also been determined that a narrower strip width 32 and a thinner substrate 22 are desirable. In addition, having a higher permitivity of perturber 18 than that of substrate 22 in most cases tremendously increases the amount of phase shift.

Based on these criteria, it has been determined that a phase shifter having the general configuration shown in FIGS. 1A and 1B is particularly advantageous when formed with the following parameters: a permitivity of perturber 18 of 10.8, a height, or thickness 34, of 0.010 inches, and a width 32 of microstrip line 20 of 0.005 inches. This results in a characteristic impedance in microstrip line 20 of 64 ohms at 40 gigahertz. In addition, in such an embodiment, substrate 22 has a metal thickness of 17 micrometers with a root-mean-squared surface roughness of 0.3214 micrometers. Such an embodiment also allows a reduced length piezoelectric transducer of 1.2, a lower maximum bias voltage on electric lines 26 of 30 V and better linearing.

Thus, a relatively low cost phase shifter is provided that results in desirable operation. The above-described phase shifters in one embodiment may provide phase shifts of 460° with an increased insertion loss of less than 2 dB and a total loss of less than 4 dB at 40 GHz.

Figure 2:
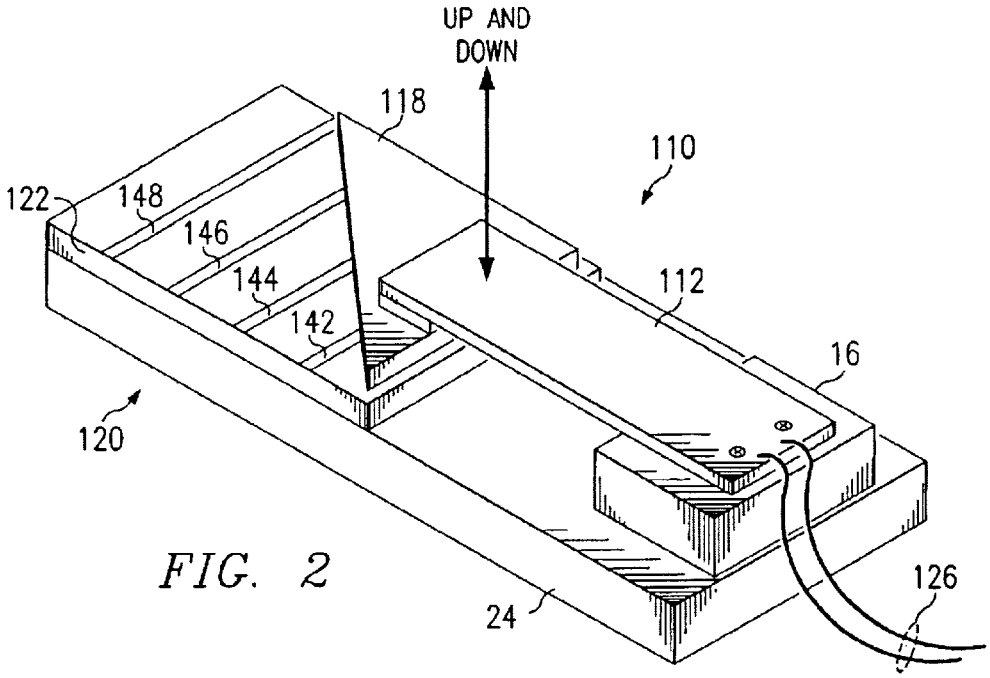
FIG. 2 is an isometric drawing of a piezoelectric transducer according to a second embodiment of the invention utilizing a plurality of microstrip lines and a triangular perturber.

FIG. 2 is an isometric drawing of a multi-line phase shifter 110 according to the teachings of the invention. Multi-line phase shifter 110 may be substantially similar to piezoelectric transducer phase shifter 10 (FIGS. 1A, 1B) except in two respects. First, multi-line phase shifter 110 includes a plurality of microstrip lines 120 rather than a single microstrip line. Microstrip lines 120 are identified as microstrip line 142, microstrip line 144, microstrip line 146, and microstrip line 148. In the multi-line phase shifter 110 shown in this embodiment, perturber 118 is formed in the configuration of a triangle rather than a rectangle or square to effect a progressive phase shift; however, other configurations for perturber 118 may be used, including rectangular. In all other respects, multi-line phase shifter 110 is similar to piezoelectric transducer phase shifter 10 (FIGS. 1A, 1B). In one embodiment, perturber 118 contacts microstrip lines 120 at progressive locations along the lengths of microstrip lines 120, as shown in FIG. 2.

Although the dimensions and physical characteristics of multi-line phase shifter 110 may vary according to desired outcome, particular parameters used in one instance are as follows. Substrate 122 is formed from RT/DUROID 5870, a high frequency laminate, with a dielectric constant of 2.33 and a height of 0.031 inches. Microstrip lines 120 each have a length of three inches and a width of 0.0917 inches. Perturber 118 is generally triangular with a dielectric constant of 60 and a thickness of 0.05 inches.

The resulting phase shift through any of microstrip lines 20 is proportional to the length over which perturbation occurs. Therefore, perturber 118 is designed to have a length over each microstrip line 120 that is equal to 0, 0.7, 1.4 and 2.1 inches, for microstrip lines 148, 146, 144, and 142, respectively. This triangular configuration for perturber 118 accomplishes differential phase shifting of 0, Φ, 2Φ, and 3Φ required for beamed steering, where (D is the desired progressive phase shift angle.

In operation, a voltage is applied on electrical wires 126, which causes deflection of piezoelectric transducer 112. This in turn causes an up and down perturbation of perturber 118, resulting in the disturbance of the electromagnetic fields along microstrip lines 142, 144 and 146. The field surrounding microstrip line 148 is substantially undisturbed because perturber 148 is designed to not interact with that field. As a result of the perturbation, a phase shift is introduced into microstrip lines 146, 144 and 142. The magnitude of such phase shift is approximately proportional to the length of perturber 118 over the microstrip line. Therefore, microstrip lines 148, 146, 144, and 142 exhibit a generally linear phase shift characteristic.

As described in greater detail below, multi-line phase shifters 10 and 110 may be utilized in combination with antenna elements to provide a phase-array antenna system that is controlled by the multi-line phase shifters. Such phased array antenna systems are described below in conjunction with FIGS. 3, 4A, 4B, 5, and 6.

Figure 3:
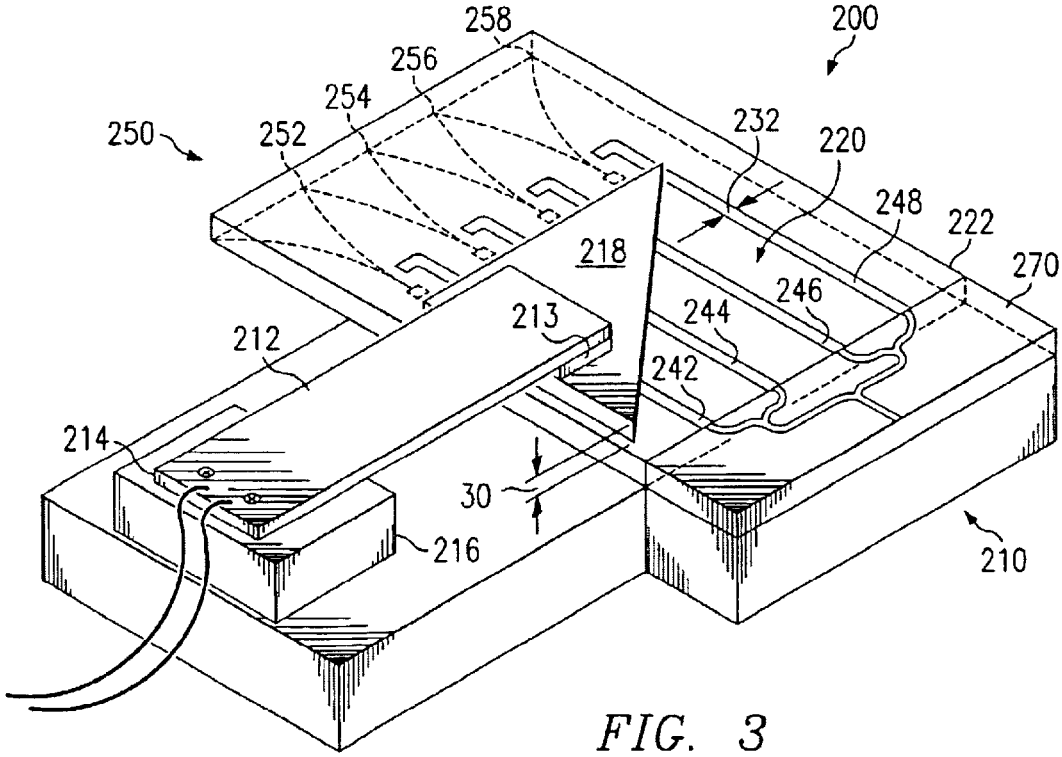
FIG. 3 is an isometric drawing of an E-plane phased array antenna according to yet another embodiment of the invention.

FIG. 3 is a perspective drawing of a phased-array antenna system 200 according to the teachings of the invention. Phased-array antenna system 200 includes a multi-line phase shifter 210, which may be similar to multi-line phase shifter 110, and an antenna system 250, which may be steered by multi-line phase shifter 210. Antenna system 250 includes a plurality of antennas 252, 254, 256, and 258.

Phase shifter 210 includes a piezoelectric transducer 212, a supporter 216 at a first end 214 of transducer 212, a perturber 218, and a substrate 222 found with a plurality of microstrip lines 220. Microstrip lines 220 involve microstrip lines 242, 244, 246, and 248. These components of piezoelectric transducer 212 may be substantially similar to the corresponding components in piezoelectric transducer 110, described above. In this example, a connector 213 is utilized to attach perturber 218 to piezoelectric (transducer 212; however, in other embodiments piezoelectric transducer may attach to perturber 218 without such a connector or transducer 212 and perturber 218 may be formed integral with one another. Attaching structure 213 may be any suitable mechanical structure for coupling piezoelectric transducer 212 to perturber 218. Attaching structure 213 may be electrically conductive or insulative. A power divider 270 may be used to provide power to microstrip lines 242, 244, 246, 248.

In operation, phase shifter 210 introduces a progressive phase shift into microstrip lines 242, 244, 246, 248, as described above in conjunction with phase shifter 110. The progressive phase shifts result is a desired beam steering angle of antenna system 250.

The parameters and dimensions of multi-line phase shifter 210 varying depending upon desired characteristics for phased-array antenna system 200. A description of how to select such parameters is provided below.

One method for effecting beam steering of the beam angle in antenna system 200 is providing a progressive phase shift Φ by multi-line phase shifter 210. Thus beam steering is accomplished by introducing a phase shift of O in microstrip line 248, (in microstrip line 246, 2Φ in microstrip line 244, and 3Φ in microstrip line 242. The amount of phase shift (varies according to the desired operation of antenna system 200; however, 30° of beam steering is one desirable amount.

The parameters of multi-line phase shifter 210 that produce a phase shift of 30° is determined as follows. First an antenna spacing is determined for antennas 252, 254, 256, and 255 according to conventional techniques, such as be those described in R. C. Hansen, *Phased Array Antennas*, New York: John Wiley & Sons, 1998; P. H. Schaubert & J. Shin, "Parameter Study of Tapered Slot Antenna Arrays," *IEEE Int. Antennas and Propagat. Symp. Digest*, Newport Beach, Calif., 1995, and P. H. Schaubert, "A class of E-plane scan blindness in single-polarized arrays of tapered-slot antennas with a ground plane, *IEEE Trans. Antenna Propagat*, Vol. 44, No. 7, July 1996, which are hereby incorporated herein by reference. This spacing determination may include considering grating lobes, and scanning blindness. In this embodiment, an antenna element spacing of 0.340 inches is determined.

With a set antenna spacing the phase shift angle α is determined from the following equation:

$$\theta_o = \sin^{-1}\left(\frac{\Phi}{k_o \cdot d}\right) \quad (1)$$

where $\theta_o$ is the beam scanning angle, d is the distance between two neighboring antenna elements, $k_o$ is the propagation constant in the free space, and $\Phi$ is the progressive phase shift, using values of $\theta_o$=30°; d=0.340 inches. This results in a phase shift angle $\Phi$ of 51.5° at 10 gigahertz.

Thus, the phase shift of perturbed microstrip line 146 with respect to the phase of unperturbed microstrip line 148, called a differential phase shift, is 51.5°. The differential phase shifts of 144 and 142 are 103° and 154°, respectively.

In order to achieve this phase shift, the length of perturber 118 at the intersection of each of microstrip lines 120 may be selected according to the following description. The length of perturber 118 is calculated from the equation $$\Delta\Phi_n = L_{pert,\ n} \cdot \Delta\beta_n \quad (2)$$

where $\Delta\Phi_n$ is a differential phase shift, $L_{pert,\ n}$ is the perturbed length, and a differential propagation constant $\Delta\beta_n$ is $(\beta_4 - \beta_{pn})$. In one embodiment, P4 refers to a propagation constant of a fourth microstrip line. The fourth microstrip line's value is used as a reference to calculate $\Delta\beta_n$. Here $\beta_{pn}$ is a perturbed propagation constant line n. In addition, $\Delta\beta_n$ is proportional to the frequency, and so is $\Delta\Phi_n$. The non-linear frequency dependence of $\Delta\beta_n$, i.e. dispersion, is included in a variational calculation. Such analysis may be performed according to M. Kirsching and R. H. Jansen, "Accurate model for effective dielectric constant of microstrip with validity up to millimeter-wave frequencies," *Electron. Lett.*, Vol 18, no 6, pp. 272–273, Mar. 18, 1982; A. K. Verma and G. H. Sadr, "Unified dispersion model for multilayer microstrip line," *IEEE Trans. Microwave Theory and Tech.*, Vol. 40, No. 7, pp. 1587–1591, July 1992, which and hereby incorporated by reference.

According to such analysis, microstrip lines 120 are formed on a RT/DUROID 6010.8 substrate 222 with a dielectric constant of 10.8 and thickness of 0.025 in. A high dielectric-constant of 10.8 is used for a substrate 222 of phase shifter 210 to reduce the length of phase shifter 210. The distance between microstrip lines 242, 244, 246, 248 is the same as the antenna element spacing of 0.340 in. A total length of 2 inches for microstrip lines 242, 244, 246, 248 is sufficient to obtain the desired phase shifts for beam steering of 30°. A width 232 of 0.022 inches for microstrip lines 242, 244, 246, 248 is designed for a high characteristic impedance of 55 Ω to compensate for a decreased characteristic impedance due to dielectric perturbation. At the maximum perturbation, i.e. when the dielectric perturber is placed on the microstrip line, the characteristic impedance of microstrip lines 242, 244, 246, 248 is close to 50 Ω.

As described above, the particular dimensions and parameters used for the phase shifter may vary depending on application; however, the following dimensions and parameters were used in this embodiment. Dielectric perturber 218 has a dielectric constant of 10.8 and thickness of 0.050 inches. The length of perturber 218 at each microstrip line 242, 244, 246, 248 is varied linearly (0.6, 1.2, and 1.8 in). Piezoelectric transducer 212 has a size of 2.75 (length)×1.25 (width)×0.085 $in^3$ (thickness including supporter 214) with a composition of Lead Zirconate Titanate. Thus the total size of the phase shifter is 4×2 $in^2$. A smaller size can be realized if a smaller piezoelectric transducer is available.

As shown, antenna array 250 comprises a plurality of antennas 252, 254, 256, 258 formed on substrate 222. Therefore antenna array 250 is in the E-plane. E-plane refers to a plane parallel to the electric field of the radiation emitted by an antenna.

An advantage of the E-plane phased array antenna array 250 is its simple fabrication. Antenna array 250 may be fabricated on substrate 222, the same substrate on which microstrip 220 is formed. In this example, antennas 252, 254, 256, and 258 are microstrip-fed Vivaldi antennas. A strip line 260 (FIG. 4) feeds the Vivaldi antennas.

As with substrate 122 of FIG. 2, substrate 222 is fabricated, in this embodiment, from RT/DUROID 5870 with a dielectric constant of 2.33 and thickness of 0.031 inches; however other suitable dimensions and parameters may be used. Selecting a substrate material with a higher dielectric it constant provides a larger phase shift as compared to one with a lower dielectric constant. Because a dielectric constant of 2.33 is relatively low, the length of substrate 222 and microstrip lines 242, 244, 246, and 248 is 3 inches, rather than the 2 inches configuration of piezoelectric phase shifters 10 and 110 to compensate for the lower dielectric constant. In one embodiment power divider 270 has low loss and small amplitude and phase imbalance and operates at 20 GHz; however, other power dividers may be used.

To achieve a larger phase shift, perturber 218 is formed to have a higher dielectric constant of 6. As a side effect, this reduces the operating frequency of phase shifter 210, in one embodiment, from 40 to 24 GHz because the higher dielectric constant perturber 218 produces not only a larger phase shift but also a higher loss. The total size of phased array antenna system 200 is 7.7 (length)×4.5 (width)×0.6 (height) $in^3$, which is relatively small and therefore desirable.

Thus, an antenna system is provided that is steered by a relatively low cost phase shifter according to the teachings of the invention.

Figure 4B:
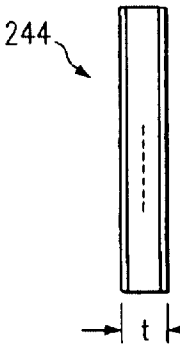
FIGS. 4A and 4B are plan views of a single stripline-fed Vivaldi antenna that may be used with the invention.
Figure 4A:
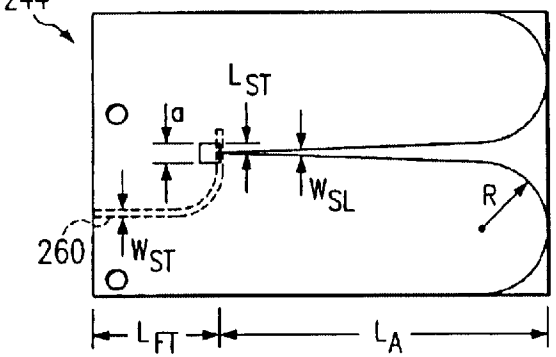

FIG. 4A is a plan view and FIG. 4B is an end view of an example stripline-fed Vivaldi antenna 244. As described in conjunction with FIG. 3, in this embodiment substrate 222 is RT/DUROID 5870 with a dielectric constant of 2.33 and thickness (t) of 40 mil, as shown in FIG. 4B; however other materials and parameters may be used according to the desired application. A transition part of antenna 244 has a strip line width ($W_{ST}$) of 29.4 mil, transition length of the strip line ($L_{ST}$) of 102.4 mil, slotline width ($W_{SL}$) of 7.87 mil, and transition length of the slot line (a) of 86.6 mil as shown in FIG. 4A; however other materials and parameters may be used according to the desired application. These parameters were determined from a full-wave analysis using the method of moment software having the name IE3D®, a simulation and optimization software solving current distribution of 3D and multilayer structures of general shape. In this embodiment, the length of strip line feeding and transition ($L_{FT}$) is 0.5 in, and the length of the exponentially tapered and round-end antenna ($L_A$) is 1.47 in (=1.25 $\lambda_o$ at 10 GHz), and the rounded end design has a radius (R) of about 0.35 in and a height (H) of 1.5 in. The array operates over 8 to 26 GHz.

Figure 5:
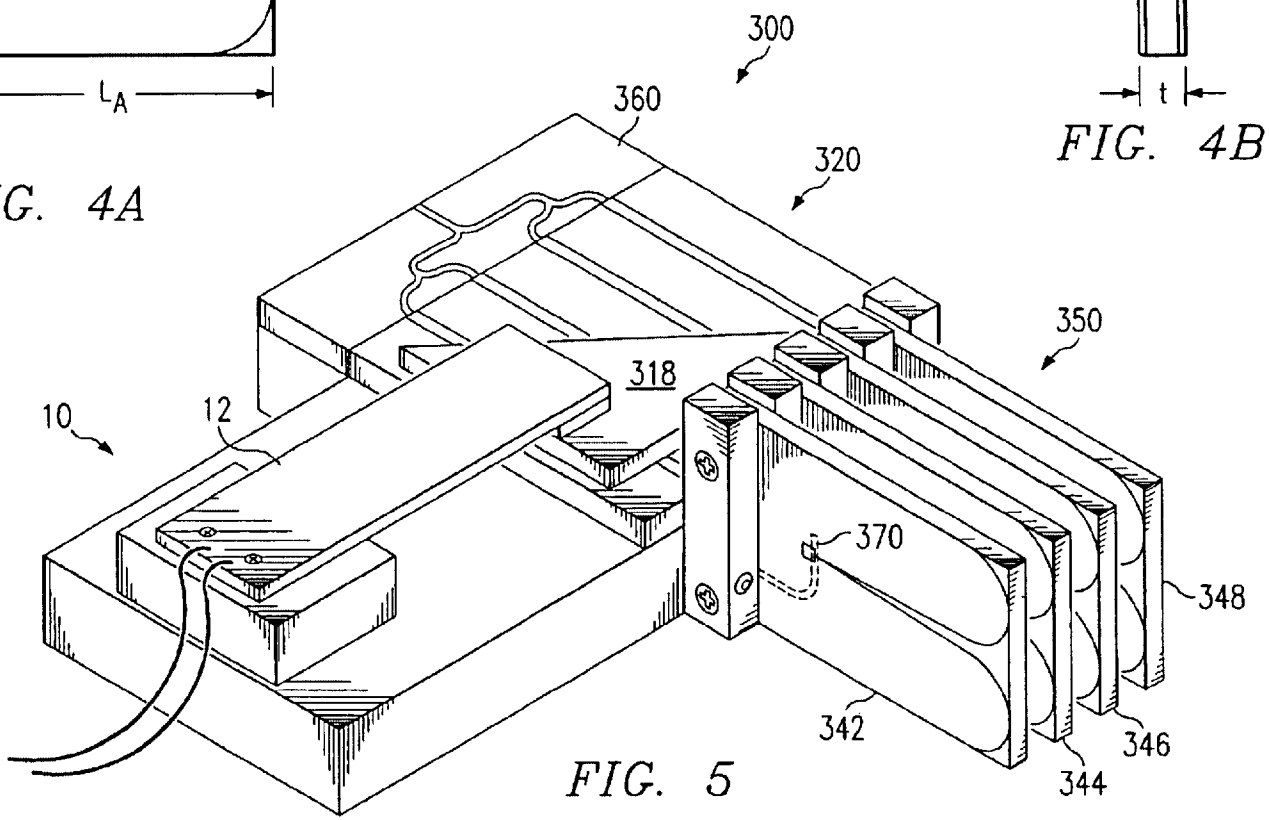
FIG. 5 is an isometric drawing of an H-plane phased array antenna according to the teachings of the invention.

FIG. 5 is a perspective drawing of a phased array antenna system 300 according to the teachings of the invention. Phased array antenna system 300 is substantially similar to system 200 except that it includes a Vivaldi antenna array 350 oriented in the H-plane rather than the E-plane. H-plane refers to the plane of an antenna in which lies the magnetic field vector of linearly polarized radiation.

As shown in FIG. 5, the H-plane phased array antenna system 300 includes a power divider 360, a progressive multi-line phase shifter 310, and a round-end stripline-fed Vivaldi antenna array 350. A direct vertical transition 370 between microstrip lines 320 and an antenna array 350 is much simpler and reduces the size and cost of the system since no extra connector is used.

Particular dimensions utilized in this embodiment, which may be varied according to application, are: the spacing between each antenna 342, 344, 346, 348 is designed to be 0.340 inches and is equal to the spacing of microstrip lines 320 in piezoelectric phase shifter 310, and phased array antenna system 300 has a size of 4.6×4×1.75 $in^3$. The stripline-fed structure gives a better cross-polarization characteristic than the microstrip line-fed one due to the symmetry.

Antenna system 300 operates in substantially the same manner as antenna system 200 of FIG. 3, but operates in the H-plane rather than the E-plane. Thus an antenna system that operates in the H-plane is provided that is controlled by a phase shifter constructed according to the teachings of the invention.

Figure 6:
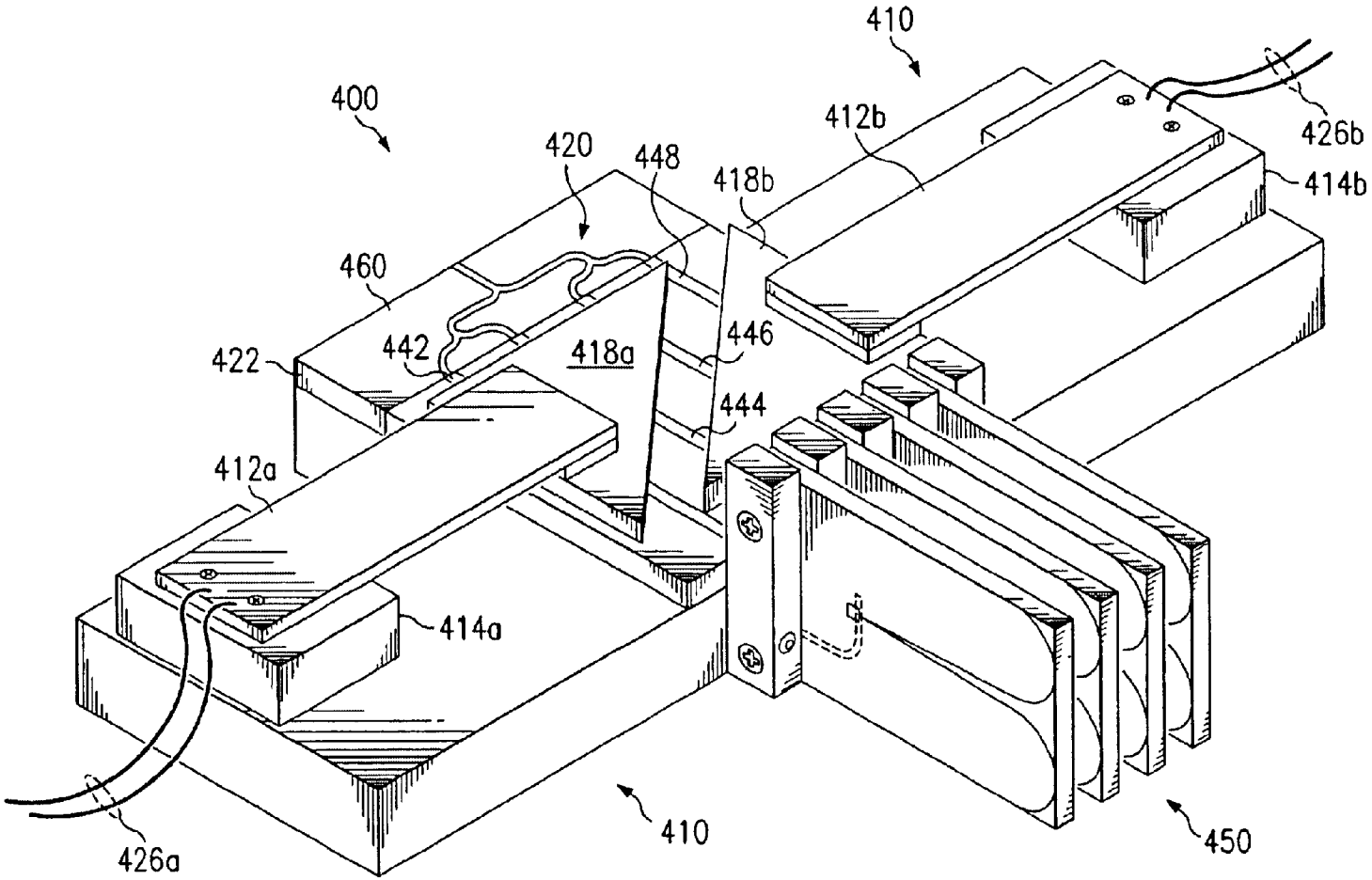
FIG. 6 is an isometric drawing of a H-plane phase array antenna using two differently aligned piezoelectric transducer phase shifters according to the teachings of the invention.

FIG. 6 is an isometric drawing of a bi-directionally steered phased array antenna system 400 controlled by a dual piezoelectric transducer phase shifter 410. Antenna system 400 includes a stripline-fed Vivaldi antenna array 450 coupled to dual piezoelectric transducer phase shifter 410. Dual piezoelectric transducer phase shifter 410 includes dual piezoelectric transducers 412*a*, 412*b* supported by respective supporters 414*a*, 414*b*. Phase shifter 410 also includes perturbers 418*a*, 418*b* and a plurality of microstrip lines 420 found on a substrate 422. Microstrip lines 420 include microstrip lines 442, 444, 446, and 448. Vivaldi antenna array 450 includes Vivaldi, or exponentially tapered slot, antennas aligned in the H-plane. Antenna system 400 also includes a power divider 460 for providing power to phase shifter 410 and antenna array 450.

In this embodiment, phased array antenna system 400 is designed to operate over the X, Ku, K bands from 8 to 26 GHz; however, other suitable frequency ranges may be prescribed. Power divider 460 is a low loss and broadband 1×4 power divider and was designed using the Chebyshev $4^{th}$ order transformations to operate from 2 to 29 GHz with a small phase difference of less than 4°; however, other suitable power dividers may be used.

Oppositely aligned piezoelectric transducers 412*a*, 412*b* are controlled, in this embodiment, by only one voltage supply. One is aligned for top-down perturbation and the other for bottom-up perturbation. Twin bias wires 426*a*, 426*b* of both piezoelectric transducers 412*a*, 412*b* are oppositely connected together. Thus if one piezoelectric transducer phase shifter is going down, the other one is going up simultaneously, and vice versa, by one control voltage. In one embodiment, the first and second transducers 412*a* and 412*b* are configured to deflect in opposite directions in response to a common applied voltage.

In operation, a voltage applied to lines 426*a*, 426*b* results in displacement of piezoelectric transducer 412*a* in one direction and 412*b* in the other. This results in a progressive phase shift in microstrip lines 442, 444, 446, 448 as described above in conjunction with FIG. 3. However, the magnitude of such phase shift may double because while one perturber is displaced upward, the other is displaced downward. This results in a swing in phase shift between microstrip lines 442 and 448 of between a maximum negative value and a maximum positive value, rather than between zero and a maximum value.

Particular dimensions and parameters utilized in this example embodiment are provided below; however, other parameters and dimensions may be used. As described above, the amount of the differential phase shift can be maximized with a higher permitivity substrate 422 and perturber 418*a*, 418*b*; thicker perturber 418*a*, 418*b*; narrower strip width of microstrips 420; and thinner substrate 422. The optimization results in a reduction of the required control voltage applied to lines 426*a*, 426*b* and an improvement of the linearity of the phase shifting versus frequency.

Additional particular dimensions and parameters utilized in this example embodiment are provided below; however, other parameters and dimensions may be used. In this embodiment, each perturber 418*a*, 418*b* has a dielectric constant of 10.8, thickness of 0.050 inches, and perturbation length of 1.2 inches on a substrate 422 having a dielectric constant of 10.8, thickness of 0.010 inches, and a line width of 0.005 inches; however, other suitable dimensions and parameters may be used. In this example, substrate 422 is RT/DUROID 5870 with a dielectric constant of 2.33, thickness (t) of 40 mil, and the stripline width of 29.4 mil, and the length of antenna is 1.47 in (=1.25 $\lambda_o$ at 10 GHz). The round-end design has a radius of about 0.35 in and the height is 1.5 in. The total size of the system is 4×6 $in^2$. A smaller size can be realized if a smaller piezoelectric transducer 412*a*, 412*b* is available. The four microstrip-lines of the piezoelectric transducer phase shifter are directly, perpendicularly connected to stripline-fed antennas so that extra connectors are unnecessary, and the system size and cost is thus reduced.

Antennas in antenna array 450 are spaced 0.010 inches from each other. This spacing is determined according to the procedure described above, and includes: considering grating lobes, and scanning blindness. To achieve 30° of beam steering, the progressive phase shift of each line is designed to be about 60° at 10 GHz. To obtain the maximum phase shift of 180° (=3×60°), the chosen perturbation length of the perturber is 1.8 in. The length of triangular dielectric perturber is varied linearly (0.6, 1.2, and 1.8 in) at each line. The Vivaldi antenna of this example embodiment operates from 8 to 26.5 GHz. A round-end Vivaldi antenna results in an improved return loss response. The stripline-fed structure gives a better cross-polarization characteristic than a single microstrip line-fed piezoelectric transducer due to the symmetry.

Thus, another embodiment at an antenna system that is controlled by a piezoelectric transducer is provided.

Although the present invention has been described with several example embodiments, various changes and modifications may be suggested to one skilled in the art. It is intended that the present invention encompass those changes and modifications as they fall within the scope of the claims.

What is claimed is:

1. An apparatus for introducing phases shift into an electric circuit comprising:

a piezoelectric transducer arm having a first end and a second end configured to deflect in response to an applied voltage, the second end coupled to a supporter, wherein the piezoelectric transducer has a rectangular cross-section;

a microstrip line;

a dielectric perturber coupled to the first end of the piezoelectric transducer arm;

separated from the microstrip line by a gap, and configured to deflect in response to deflection of the piezoelectric transducer arm;

wherein deflection of the dielectric perturber causes a phase shift in an electric current flowing through the microstrip line;

wherein the piezoelectric transducer is configured to deflect 0 to 2 mm in response to the applied voltage; and wherein the supporter and the microstrip line overlie a substrate, the dielectric perturber having a higher permitivity than the substrate.

2. The apparatus of claim 1, wherein the piezoelectric transducer comprises lead zirconate titanate.

3. The apparatus of claim 1, wherein the microstrip line is disposed on the substrate.

4. An apparatus for introducing phase shift into an electric circuit comprising:

a piezoelectric transducer arm having a first end and a second end configured to deflect in response to an applied voltage the second end coupled to a supporter;

a plurality of substantially parallel microstrip lines;

a perturber coupled to the first end of the piezoelectric transducer arm, disposed proximate the plurality of microstrip lines and configured to deflect in response to deflection of the piezoelectric transducer, wherein the perturber has a substantially triangular cross-section such that deflection of the piezoelectric transducer causes a different phase shift to be progressive in each of the plurality of microstrip lines; and wherein the perturber contacts the plurality of microstrip lines at progressive locations along the lengths of the plurality of microstrip lines.

5. The apparatus of claim 4, further including an additional microstrip line that is not perturbed by the perturber.

6. An apparatus for introducing phase shift into an electric circuit comprising:

first and second piezoelectric transducers, each transducer configured to deflect in response to respective applied voltages;

a plurality of microstrip lines;

first and second perturbers separated from each of the plurality of microstrip lines by respective gaps and configured to deflect in response to deflection of the first and second piezoelectric transducers, respectively; and wherein deflection of the first and second perturbers causes a phase shift in an electric current flowing through each of the plurality of microstrip lines, and wherein the first and second piezoelectric transducers are configured to deflect in opposite directions in response to a common applied voltage.

7. The apparatus of claim 6, wherein the first and second piezoelectric transducers each have triangular cross-sections.

8. The apparatus of claim 6, wherein the first and second perturbers each have a triangular cross-section and disposed in relation to each other such that, when perturbed, progressive phase shifts are introduced in a first direction by the first perturber and in an opposite direction by the second perturber.

9. The apparatus of claim 6, and farther comprising a plurality of Vivaldi antennas coupled to the plurality of microstrip lines in a one-to-one fashion.

10. The apparatus of claim 9, wherein the first and second piezoelectric transducers comprise dielectric material.

11. A method comprising:

coupling a dielectric perturber to a piezoelectric transducer such that deflection of the piezoelectric transducer causes deflection of the dielectric perturber, wherein the coupling a of the dielectric perturber to the piezoelectric transducer comprises attaching the perturber to an intermediate structure that is coupled to the piezoelectric transducer, wherein the perturber is comprised of a rectangular cross-section;

positioning the dielectric perturber proximate a microstrip line; and generating a phase shift in an electric current flowing through the microstrip line by applying a voltage to the piezoelectric transducer to cause deflection of the dielectric perturber proximate the microstrip line.

12. The method of claim 11, wherein positioning the perturber proximate the microstrip line comprises maintaining an air gap between the perturber and the microstrip line.

13. The method of claim 12, wherein the air gap is in the range of 0 to 2 mm.

14. The method of claim 1, and further comprising coupling an antenna to the microstrip line.

15. The method of claim 11, wherein the dielectric constant of the perturber is approximately 10.8.

16. The method of claim 15, wherein the microstrip line is disposed on a substrate.

17. The method of claim 15, wherein the microstrip line has a characteristic impedance of 50 to 60 ohms.

18. The method of claim 11, wherein the coupling the dielectric perturber to the piezoelectric transducer, such that deflection of the piezoelectric transducer causes deflection of the dielectric perturber, comprises attaching the piezoelectric transducer to the dielectric perturber.

19. A method comprising:

coupling a perturber to a first end of a piezoelectric transducer arm such that deflection of the piezoelectric transducer causes deflection of the perturber;

positioning the perturber proximate a plurality of microstrip lines;

generating a phase shift in each of the plurality of microstrip lines by applying a voltage to the piezoelectric transducer arm to cause deflection of the perturber proximate the plurality of microstrip lines; and coupling a plurality of antennas in a one-to-one fashion to the plurality of microstrip lines, wherein coupling the plurality of antennas in a one-to-one fashion to the plurality of microstrip lines comprises coupling the plurality of antennas configured in an H-plane.

20. The method of claim 19 wherein the perturber has a configuration such that deflection of the piezoelectric transducer causes a different phase shift in each of the plurality of microstrip lines.

21. The method of claim 19, wherein the plurality of antennas comprise Vivaldi antennas.

22. The method of claim 19, and further comprising providing power to each of the plurality of microstrip lines by a power divider.

23. A phased array antenna system comprising:

an antenna array comprising a plurality of antennas, wherein the antenna array is arranged in the H-plane;

a plurality of microstrip lines connected in a one-to-one fashion with respective ones of the plurality of antennas;

a dielectric perturber disposed proximate the plurality of microstrip lines; and a piezoelectric transducer coupled to the perturber such that deflection of the piezoelectric transducer causes deflection of the perturber with respect to the plurality of microstrip lines thereby introducing a phase shift in each of the plurality of microstrip lines.

24. The phased array antenna system of claim 23, wherein the antenna array comprises a plurality of Vivaldi antennas.

25. The phased array antenna system of claim 23, wherein the perturber is configured and positioned with respect to the plurality of microstrip lines, such that a progressive phase shift is introduced into each of the microstrip lines in response to deflection of the perturber.

26. The phased array antenna system of claim 25, wherein the perturber has a triangular cross-section.

* * * * *